US009950412B2

(12) United States Patent
Fang et al.

(10) Patent No.: US 9,950,412 B2
(45) Date of Patent: Apr. 24, 2018

(54) TORQUE WRENCH

(71) Applicants: Tien Yu Fang, Taichung (TW); Hsin Pu Fang, Taichung (TW); Yu Chen Chu, Taichung (TW)

(72) Inventors: Tien Yu Fang, Taichung (TW); Hsin Pu Fang, Taichung (TW); Yu Chen Chu, Taichung (TW)

( * ) Notice: Subject to any disclaimer, the term of this patent is extended or adjusted under 35 U.S.C. 154(b) by 96 days.

(21) Appl. No.: 15/241,105

(22) Filed: Aug. 19, 2016

(65) Prior Publication Data

US 2018/0050441 A1 Feb. 22, 2018

(51) Int. Cl.
*B25B 23/142* (2006.01)
*B25B 23/00* (2006.01)

(52) U.S. Cl.
CPC ..... *B25B 23/1427* (2013.01); *B25B 23/0035* (2013.01)

(58) Field of Classification Search
CPC ..... B23B 23/0035; B23B 23/1427; B23B 23/1422; B23B 23/145; B23B 13/462
See application file for complete search history.

(56) References Cited

U.S. PATENT DOCUMENTS 2,205,501 A * 6/1940 Sunnen ..... B25B 23/1427 81/124.6
2,732,747 A * 1/1956 Livermont ..... B25B 23/1427 267/175
4,079,639 A * 3/1978 Wood ..... B25B 23/1427 81/483
2014/0352503 A1* 12/2014 Hsieh ..... B25B 23/1427 81/478
2015/0059539 A1* 3/2015 Hsieh ..... B25B 23/1427 81/467

* cited by examiner

*Primary Examiner* — Christopher M Koehler
*Assistant Examiner* — Henry Hong
(74) *Attorney, Agent, or Firm* — Charles E. Baxley

(57) ABSTRACT

A torque wrench includes a driving shank having two pivot bases, an anchor pivotally attached to one of the pivot bases and having channel formed in the anchor, a connection rod pivotally attached to the other pivot base, a housing engaged onto the connection rod, a casing disposed on the housing, a peg secured to the casing and slidably engaged in the channel of the anchor, a retainer member engaged into the casing and having a protrusion engaged into the housing, and a positioning element is engaged into the housing and engaged with the protrusion of the retainer member and for positioning the positioning element to the housing.

2 Claims, 5 Drawing Sheets

TORQUE WRENCH

BACKGROUND OF THE INVENTION

1. Field of the Invention

The present invention relates to a torque wrench, and more particularly to a collapsible torque wrench including an improved structure or configuration having an increased strength and having an increased working life.

2. Description of the Prior Art

Various kinds of typical torque wrenches have been developed and provided for conducting or operating various rotating or driving operations, and normally comprise a driving stem having a driving tool element formed or provided on one end portion thereof for engaging with and for rotating or driving the work pieces, and a torque adjusting device attached or mounted or secured to the driving stem for adjusting the allowable driving torque of the typical torque wrenches to the work pieces.

For example, U.S. Patent Application No. US 2014/0352503 A1 discloses one of the typical torque wrenches also comprising a driving stem having driving tool element formed or provided on one end portion thereof for engaging with and for rotating or driving the work pieces, and a torque adjusting device attached or mounted or secured to the driving stem for adjusting the allowable driving torque of the typical torque wrenches to the work pieces.

However, the spring biasing member may not be solidly and stably anchored or retained or positioned in the driving stem, and the spring biasing member positioning seat or member may be moved relative to the driving stem such that the spring biasing member may also be moved relative to the driving stem.

The present invention has arisen to mitigate and/or obviate the afore-described disadvantages of the conventional torque wrenches or tools.

SUMMARY OF THE INVENTION

The primary objective of the present invention is to provide a torque wrench including an improved structure or configuration having an increased strength and having an increased working life.

In accordance with one aspect of the invention, there is provided a torque wrench comprising a driving shank including a first pivot base and a second pivot base, an anchor including a first end portion pivotally attached to the second pivot base of the driving shank with a pivot axle, the anchor including a second end portion having a curved surface, and a channel formed in the anchor and having two seats, a connection rod including a first end portion pivotally attached to the first pivot base with a pivot shaft, the connection rod including an outer thread formed in a second end portion of the connection rod, a housing including a chamber formed therein for receiving the connection rod, the housing including a first end portion for selectively engaging with the first end portion of the connection rod, and including a hand grip attached to a second end portion of the housing, the housing including a slit formed therein and communicating with the chamber of the housing, a casing provided on the housing, and the casing including a compartment formed between two panels, a peg secured to the panels of the casing and extended through the compartment of the casing, the peg being slidably engaged in the channel of the anchor and engageable with either of the seats of the anchor, a retainer member engaged into the compartment of the casing and secured to the panels, the retainer member including a protrusion engaged through the slit of the housing and into the chamber of the housing, a positioning element engaged into the chamber of the housing, and including a bore formed in the positioning element for engaging with the connection rod, and including a recess formed in the positioning element for engaging with the protrusion of the retainer member and for positioning the positioning element to the housing, and for preventing the positioning element from being moved relative to the housing, a fastener threaded with the outer thread of the connection rod, and a spring biasing member engaged between the positioning element and the fastener. It is to be noted that the protrusion of the retainer member is engaged with the recess of the positioning element for solidly and stably retaining and positioning the positioning element in the housing and thus for preventing the positioning element from being moved relative to the housing.

The recess of the positioning element is preferably selected from a peripheral recess, a groove or a channel formed through the positioning element for engaging with the protrusion of the retainer member and for solidly and stably retaining and positioning the positioning element in the housing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
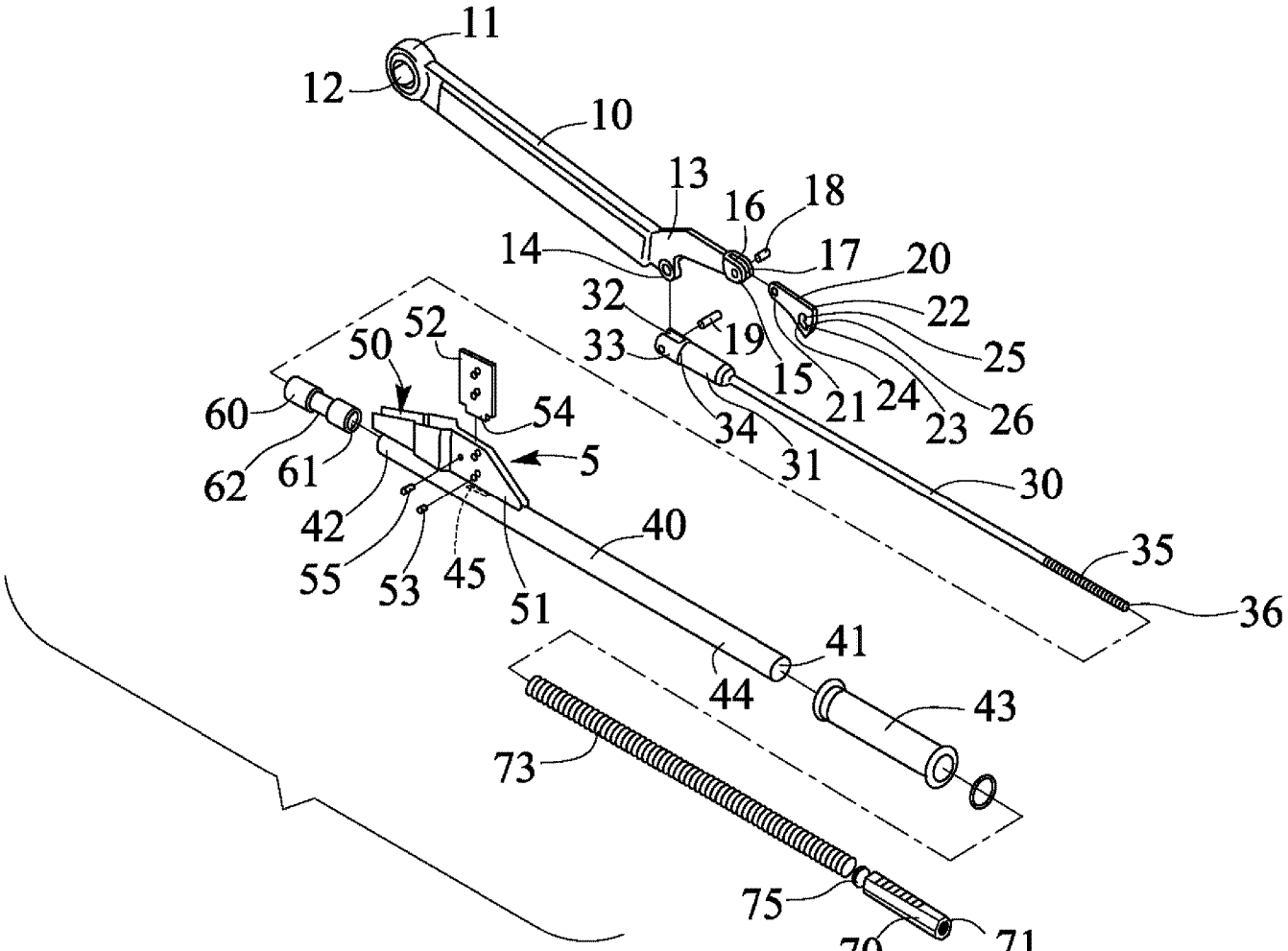
FIG. 1 is an exploded view of a torque wrench in accordance with the present invention.
Figure 2:
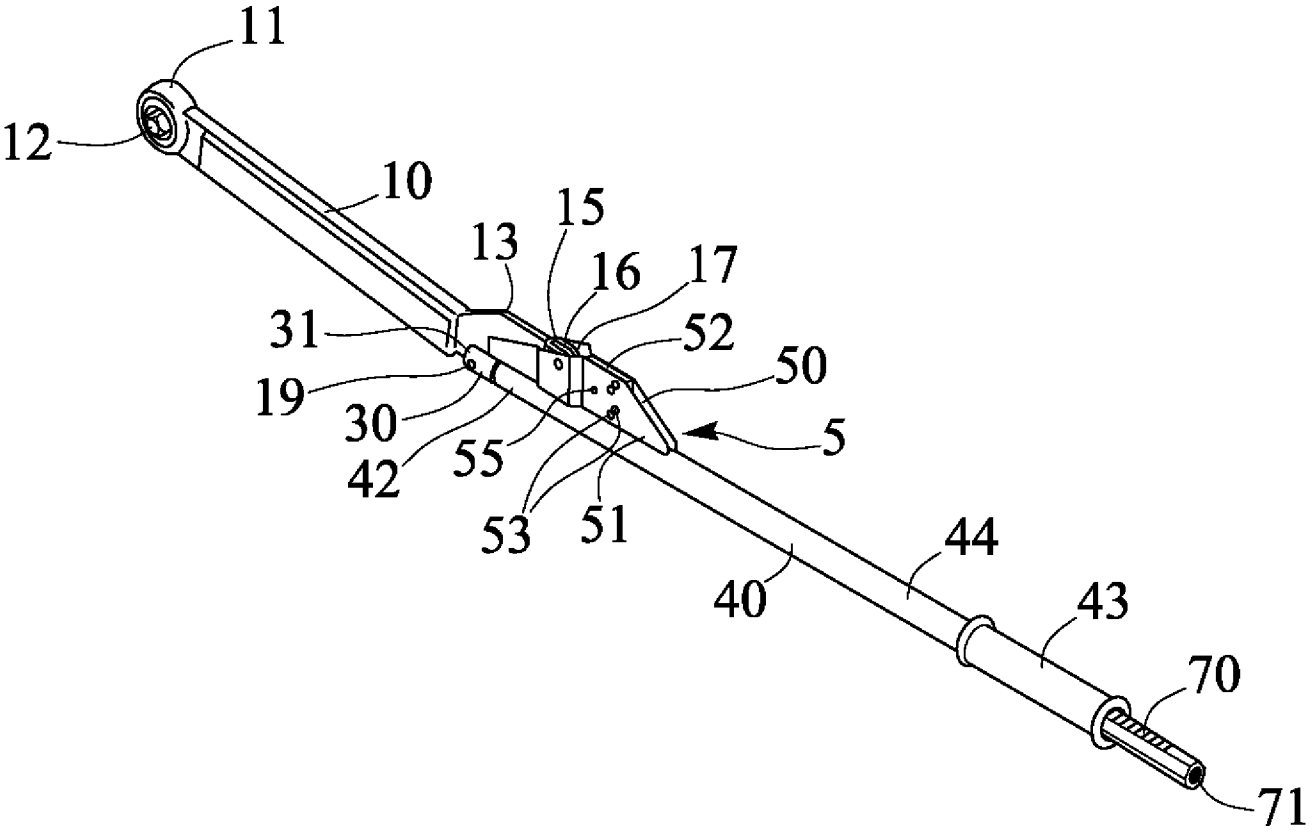
FIG. 2 is a perspective view of the torque wrench.
Figure 4:
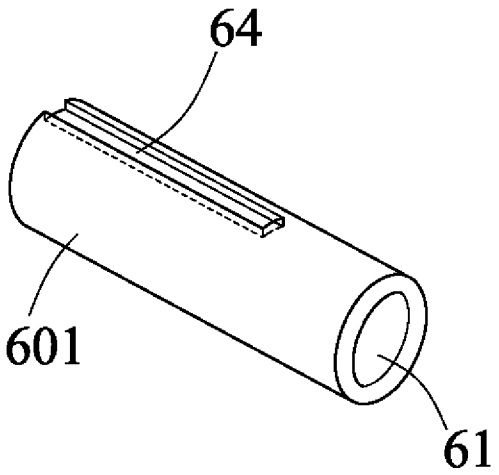
FIG. 4 is a further perspective view illustrating the other arrangement of the spring biasing member positioning seat or member for the torque wrench.

Referring to the drawings, and initially to FIGS. 1-5, a torque wrench in accordance with the present invention comprises a driving shank 10 including a front driving head 11 having a driving tool or driving stud 12 formed or provided thereon for engaging with and for rotating or driving the work pieces (not illustrated), and including a rear end portion 13 having a first pivot base 14 and a second pivot base 15, in which the second pivot base 15 includes a slot 16 formed or defined between two ears or flaps 17 for pivotally or rotatably engaging with an anchor 20. For example, the anchor 20 includes one or first end portion 21 disposed or engaged into the slot 16 that is formed or defined between the flaps 17 at the rear end portion 13 of the driving shank 10, and pivotally or rotatably attached or mounted or secured to the second pivot base 15 at the rear end portion 13 of the driving shank 10 with a pivot pin or axle 18.

The anchor 20 is pivotable or rotatable relative to the driving shank 10, and includes another or second end portion 22 having a rounded or curved surface 23 formed or provided thereon, and further includes a rounded or curved or C-shaped channel 24 formed or provided therein and having two seats 25, 26 formed or provided therein, in which the channel 24 formed or located closer to the first end portion 21 of the anchor 20 and the pivot axle 18, and the seats 25, 26 are formed or located closer to the curved surface 23 at the second end portion 22 of the anchor 20.

An elongated or longitudinal connection rod 30 includes one or first end portion 31 pivotally or rotatably attached or mounted or secured to the first pivot base 14 at the rear end portion 13 of the driving shank 10 with a pivot pin or shaft 19. For example, the connection rod 30 includes a notch 32 formed or defined between two flaps or ears 33 for engaging with the first pivot base 14 and for pivotally or rotatably attached or mounted or secured to the first pivot base 14 with the pivot shaft 19. The connection rod 30 further includes an annular or peripheral shoulder 34 formed or provided in the first end portion 31 of the connection rod 30, and further includes an outer thread 35 formed or provided in the other or second end portion 36 thereof.

An elongated or longitudinal tubular member or housing 40 includes a bore or chamber 41 formed therein for slidably receiving or engaging with the connection rod 30 and for allowing the housing 40 to be slidably engaged onto the connection rod 30. The housing 40 includes one or first end portion 42 for selectively contacting or engaging with the peripheral shoulder 34 at the first end portion 31 of the connection rod 30 (FIGS. 2, 5), and includes a hand grip 43 attached or mounted or secured to the other or second end portion 44 of the housing 40 for moving the housing 40 along and relative to the connection rod 30. The housing 40 further includes a slit 45 formed therein (FIG. 1) and intersected or communicating with the chamber 41 of the housing 40.

The housing 40 further includes a casing 5 formed or provided thereon, for example, the casing 5 includes a channel or compartment 50 formed therein and defined between two ears or panels 51, another anchor or retainer member 52 is disposed or engaged into the compartment 50 of the casing 5 and mounted or secured to the panels 51 of the casing 5 with screws or bolts or fasteners 53 or the like, and the retainer member 52 includes a stop or protrusion 54 extended therefrom and engaged into or through the slit 45 of the housing 40 and then engaged into the chamber 41 of the housing 40. A pin or peg 55 is mounted or secured to the panels 51 of the casing 5 and extended through the compartment 50 of the casing 5.

Figure 3:
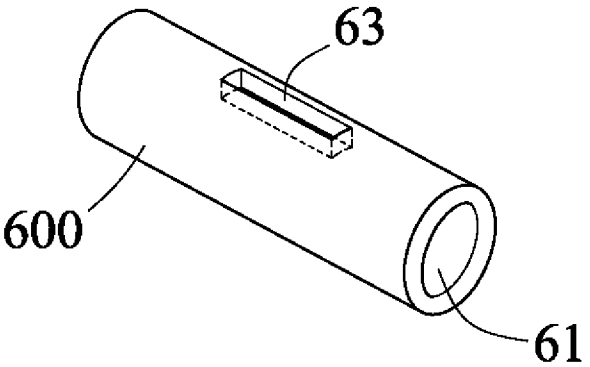
FIG. 3 is another perspective view illustrating a spring biasing member positioning seat or member for the torque wrench.

A retaining or positioning element 60 is disposed or engaged into the chamber 41 of the housing 40, and includes a bore 61 formed therein for slidably receiving or engaging with the connection rod 30, and includes an annular or peripheral recess 62 formed therein for receiving or engaging with the protrusion 54 of the retainer member 52 (FIGS. 5, 6) and for solidly and stably anchoring or retaining or positioning the positioning element 60 to the housing 40, and for preventing the positioning element 60 from being moved relative to the housing 40. Alternatively, as shown in FIG. 3, the positioning element 600 may include a groove 63 formed therein for receiving or engaging with the protrusion 54 of the retainer member 52; or the positioning element 601 (FIG. 4) may include a channel 64 formed therein for receiving or engaging with the protrusion 54 of the retainer member 52.

A screw or bolt or fastener 70 include an inner thread 71 formed or provided therein for threading or engaging with the outer thread 35 of the connection rod 30, and the fastener 70 is at least partially extended out of the hand grip 43 and/or the other or second end portion 44 of the housing 40 for allowing the fastener 70 to be pivoted or rotated relative to the connection rod 30 by the user, and a spring biasing member 73 is also disposed or engaged onto the connection rod 30 and engaged between the positioning element 60 and the fastener 70 for applying a spring biasing force between the connection rod 30 and the housing 40. One or more washers 74 may be disposed or engaged between the positioning element 60 and the spring biasing member 73 (FIGS. 5, 6), and one or more further washers 75 (FIG. 1) may be disposed or engaged between the spring biasing member 73 and the fastener 70.

Figure 5:
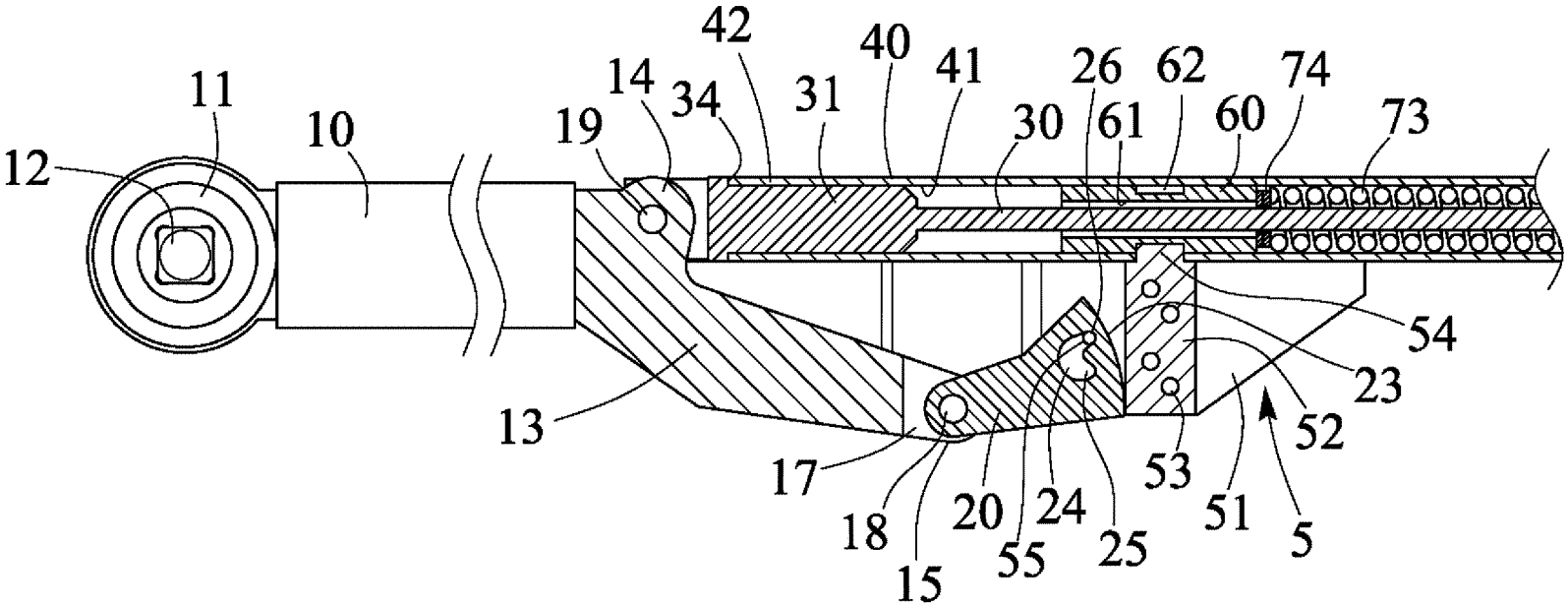
FIG. 5 is a top plan schematic view of the torque wrench, in which a portion of the torque wrench has been cut off for showing the inner structure of the torque wrench.
Figure 6:
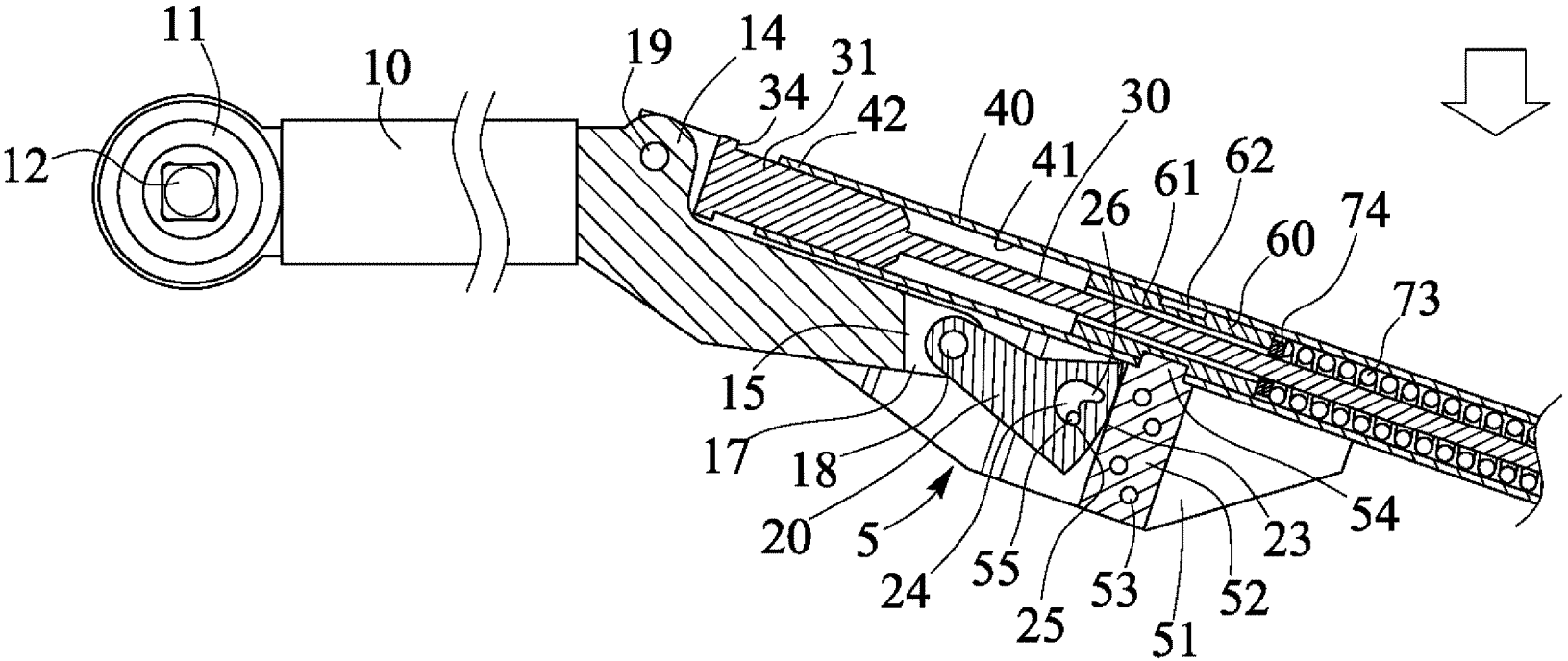
FIG. 6 is another top plan schematic view similar to FIG. 5, illustrating the operation of the torque wrench.

In operation, as shown in FIGS. 5 and 6, the positioning element 60 that is disposed or engaged into the chamber 41 of the housing 40 may be solidly and stably anchored or retained or positioned in the chamber 41 of the housing 40 by or with the engagement of the protrusion 54 of the retainer member 52 with the recess 62 of the positioning element 60 and thus for allowing the positioning element 60 and the housing 40 to solidly and stably sustain the spring biasing force of the spring biasing member 73, and thus for preventing the positioning element 60 from being moved relative to the housing 40. The curved surface 23 at the second end portion 22 of the anchor 20 may frictionally contact or engage with the retainer member 52.

As also shown in FIGS. 5 and 6, the peg 55 that is mounted or secured to the panels 51 of the casing 5 and extended through the compartment 50 of the casing 5 is slidably received or engaged in the channel 24 of the anchor 20 and engageable with either of the seats 25, 26 of the anchor 20 for solidly and stably anchoring or retaining or positioning the housing 40 and the connection rod 30 to the driving shank 10 when the connection rod 30 and the housing 40 are pivoted or rotated relative to the driving shank 10.

Accordingly, the torque wrench in accordance with the present invention includes an improved structure or configuration having an increased strength and having an increased working life.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A torque wrench comprising:

a driving shank including a first pivot base and a second pivot base, an anchor including a first end portion pivotally attached to said second pivot base of said driving shank with a pivot axle, said anchor including a second end portion having a curved surface, and a channel formed in said anchor and having two seats, a connection rod including a first end portion pivotally attached to said first pivot base with a pivot shaft, said connection rod including an outer thread formed in a second end portion of said connection rod, a housing including a chamber formed therein for receiving said connection rod, said housing including a first end portion for selectively engaging with said first end portion of said connection rod, and including a hand grip attached to a second end portion of said housing, said housing including a slit formed therein and communicating with said chamber of said housing, a casing provided on said housing, and said casing including a compartment formed between two panels, a peg secured to said panels of said casing and extended through said compartment of said casing, said peg being slidably engaged in said channel of said anchor and engageable with either of said seats of said anchor, a retainer member engaged into said compartment of said casing and secured to said panels, said retainer member including a protrusion engaged through said slit of said housing and into said chamber of said housing, a positioning element engaged into said chamber of said housing, and including a bore formed in said positioning element for engaging with said connection rod, and including a recess formed in said positioning element for engaging with said protrusion of said retainer member and for positioning said positioning element to said housing, and for preventing said positioning element from being moved relative to said housing, a fastener threaded with said outer thread of said connection rod, and a spring biasing member engaged between said positioning element and said fastener.

2. The torque wrench as claimed in claim 1, wherein said recess of said positioning element is a peripheral recess for engaging with said protrusion of said retainer member.

* * * * *